US008011348B2

(12) United States Patent
Starikovsky

(10) Patent No.: US 8,011,348 B2
(45) Date of Patent: Sep. 6, 2011

(54) METHOD FOR IGNITING, INTENSIFYING THE COMBUSTION OR REFORMING OF AIR-FUEL AND OXYGEN-FUEL MIXTURES

(75) Inventor: Andrey Yurievich Starikovsky, Dolgoprudny (RU)

(73) Assignee: Neq Lab Holding Inc., Tortola (VG)

( * ) Notice: Subject to any disclaimer, the term of this patent is extended or adjusted under 35 U.S.C. 154(b) by 521 days.

(21) Appl. No.: 12/092,309

(22) PCT Filed: Nov. 3, 2006

(86) PCT No.: PCT/IB2006/003106

§ 371 (c)(1),
(2), (4) Date: Jul. 5, 2008

(87) PCT Pub. No.: WO2007/054774

PCT Pub. Date: May 18, 2007

(65) Prior Publication Data

US 2008/0309241 A1 Dec. 18, 2008

(30) Foreign Application Priority Data

Nov. 3, 2005 (RU) ..... 2005133953

(51) Int. Cl.
*F02B 1/00* (2006.01)

(52) U.S. Cl. ..... 123/429; 123/143 B

(58) Field of Classification Search ..... 123/429, 123/594, 597, 598, 623, 628, 642, 143 B, 123/536; 701/102, 105
See application file for complete search history.

(56) References Cited

U.S. PATENT DOCUMENTS 4,774,914 A 10/1988 Ward
5,797,383 A * 8/1998 Matsubara et al. ..... 123/594
5,983,871 A 11/1999 Gordon et al.
6,651,637 B1 * 11/2003 Morrissette et al. ..... 123/609
(Continued)

FOREIGN PATENT DOCUMENTS

RU 1838665 8/1993
(Continued)

OTHER PUBLICATIONS

Anikin et al., "Ignition and Flame Control by Nanosecond Pulsed Gas Discharges", 30th EPS Conference on Contr. Fusion and Plasma Phys., vol. 27a, Nov. 7, 2003, XP002432911, the whole document.

(Continued)

*Primary Examiner* — John T Kwon
*Assistant Examiner* — Johnny H Hoang
(74) *Attorney, Agent, or Firm* — Bachman & LaPointe, P.C.

(57) ABSTRACT

A method for intensifying combustion of gas-fuel mixtures consists of stimulating the combustion mixture in a combustion chamber by a pulsed high-voltage discharge of nanosecond duration, wherein the discharge amplitude is set up according to a condition of maximising a heat input in electronic degrees of freedom and in a gas dissociation and preventing the passage of plasma electrons to an escape mode at a main discharge stage, the high-voltage pulse leading edge build-up time is limited by the condition of obtaining a homogeneous filling of a discharge gap by plasma and a pulsed energy efficient transmission to the plasma, a high-voltage pulse time is limited by the condition, wherein a highly-unstable plasma state is attained, the discharge gap resistance is reduced, the discharge gap is better matched to a generator, and an efficient electric power input into the plasmas is obtained.

2 Claims, 7 Drawing Sheets

U.S. PATENT DOCUMENTS

| | | | | |
|---|---|---|---|---|
| 6,889,676 | B2 * | 5/2005 | Morrissette et al. | 123/594 |
| 7,013,881 | B2 * | 3/2006 | Metzelard | 123/594 |
| 7,093,422 | B2 | 8/2006 | Ponziani et al. | |
| 7,134,407 | B1 * | 11/2006 | Nelson | 123/54.4 |
| 7,267,115 | B2 * | 9/2007 | Naruse et al. | 123/594 |
| 7,267,116 | B2 * | 9/2007 | Miwa et al. | 123/169 EL |
| 7,418,956 | B2 * | 9/2008 | Aida et al. | 123/605 |

FOREIGN PATENT DOCUMENTS

| | | |
|---|---|---|
| RU | 2099550 | 12/1997 |
| SU | 1728521 | 4/1992 |
| WO | 93/10348 | 5/1993 |

OTHER PUBLICATIONS

Kosarev et al., "Ignition of Homologicial Series of Hydrocarbons by Volume Nanosecond Discharge", Minsk International Colloquim on Physics of Schock Waves, Combustion, Detonation and Non-Equilibrium Processes (MIC 2005), Nov. 12, 2005, XP002432912, pp. 1-10.

Starikovskaia, "Plasma Assisted Ignition and Combustion", Journal of Physics D: Applied Physics, Aug. 4, 2006, XP002432914, United Kingdom, pp. R265-R299.

Guofeng et al., "Ignition of Premixed Hydrocarbon-air Flows by Repetitively Pulsed, Nanosecond Pulse Duration Plasma", 31st International Symposium on Combustion, Aug. 11, 2006, XP002432913, Germany, pp. 1-26.

Axel et al., "Plasma Assisted Combustion: Effect of a Coaxial DBD on a Methane Diffusion Flame", Plasma Sources Science and Technology, Dec. 20, 2006, XP002432915, United Kingdom, pp. 149-160.

Ronney, "Flame Initiation by Nanosecond Plasma Discharges: Putting Some New Spark into Ignition", Bernard Lewis Visiting Lecturer, Fellowship, Oct. 3, 2005, XP002432916, Taiwan, the whole document.

RWTH AACEN: "3.2 Zuendung" Internet Citation, [Online] XP002364047 Retrieved from the Internet: URL:http://www.vka.rwth-aachen.de/sfb_224/Kapitel/pdf/kap3_2.pdf> [retrieved on Jan. 23, 2006], the whole document.

* cited by examiner

METHOD FOR IGNITING, INTENSIFYING THE COMBUSTION OR REFORMING OF AIR-FUEL AND OXYGEN-FUEL MIXTURES

FIELD OF THE INVENTION

This invention relates to mechanical engineering, and more particularly, to power engineering industry and engine-building, and is designed for intensification of chemical processes in the combustible mixture using pulsed periodic nanosecond high-voltage discharge in internal combustion engines of any kind, including (without limitation) afterburners, combustors of detonation engines, jet engines and gas turbine engines, in power burners and reformers.

BACKGROUND OF THE INVENTION

There are several methods aimed at intensification of combustible mixtures combustion in internal combustion engines combustion chambers. Most widely-spread methods are those using preliminary preparation of combustible mixture, including electric-discharge treatment of air, inject fuel treatment with electromagnetic field, methods based on improvement of electric spark ignition of combustible mixtures, and in the latter case the result is achieved by way of modification of electric ignition spark plugs design (SU No. 1728521, SU No. 1838665, RU 2099550).

There is a known method of combustion processes activation allowing to increase effectiveness and uniformity of combustible mixture combustion in internal combustion engines, to reduce combustion induction time, ignition temperature and to provide controlled increase of combustion front propagation rate (RU No. 94028477, F02M25/10, 1996). Such a method consists in treatment of air fed to the internal combustion engine by the system of volumetric self-maintained discharges with set-up parameters.

Disadvantages of known methods are the requirement for modifications in the engine design and imperfection of usual electric spark ignition method for combustible mixture ignition which does not provide complete combustion of mixture in chambers.

The nearest prior art to the present invention is the method of combustible mixture ignition using streamer spark plug (RU No. 2176122, H01T13/20, 2001). In this invention streamer phenomenon is used for increase of ionization rate in the zone of generation of main electric discharge by means of creation of favourable conditions for stable spark formation. The solution of this aim consists in placing voltage between the plug centre and side electrodes which provides ionization of space between them. At that at the centre electrode insulator streamer is formed, ionization field in the zone limited by ground starting electrode circuit is amplified, and electric discharge between the centre electrode and the spark-receiving surface of the ground electrode main part is formed. This invention provides stability of operation of internal combustion engines, including those used in motorcycle systems, in all possible modes of operation.

The above prior art is of limited application as it is intended for use only in gasoline engines (car and motorcycle engines).

DISCLOSURE OF THE INVENTION

Fuel oxidation reaction proceeds by a branched-chain mechanism.

From the theory of branched radical-chain reactions the following is known:

1. Elementary steps. The characteristic feature of chain reactions is that chemical agents consumption and final products formation occur via sequence of recurrent elementary steps at which source material particles-active species reaction results in formation of the reaction product molecule and new active species [6]. For the purposes of this paper "active species" means a particle with unlinked valence bond (free atoms and radicals; in this case radical and chemical chains are usually mentioned) or valence-saturated species in excited energy state (in this case energy chains are usually mentioned).

When classifying chain reactions elementary steps we can distinguish four moments: chain initiation, chain-propagating, chain-branching and chain-termination steps. Chain propagation reaction (reaction between molecules and radicals) resulting in simultaneous formation of the product and generation of a new active species proceeds rather rapidly. Initiation reaction (primary formation of active species) is the most energy-consuming step of the chain process [7].

Branching chain reactions always include chain-branching step in addition to chain initiation, chain-propagating and chain-termination steps. At development of the claimed invention CH4-C5H12 and H2-containing mixtures which inflammation, as per N. N. Semionov's theory, occurs by a branched radical-chain mechanism were considered [5]. A branching chain reaction differs from an unbranched chain reaction in that during its proceeding energy transfer to endothermic steps occurs due to exothermic steps. This energy can accumulate in the course of reaction either in the form of chemical energy of atoms and free radicals or in the form of energy of excited molecules [8].

2. Induction period. A branching chain reaction can proceed in two ways. Where the rate of chain termination exceeds the rate of chain branching concentration of active sites is quasi-stationary. Otherwise, when the rate of chain branching starts to exceed the rate of radical and atom chains termination exponential growth of active species occurs and after a little while extremely weak reaction begins to proceed explosively [6]. The period during which radicals generation occurs and temperature and pressure practically do not change is called ignition induction time (ignition delay time).

3. Formation of initial concentration of active sites. The reaction limiting combustion propagation is active sites formation. In case of oxidation proceeding by a branched radical-chain mechanism initiation step has a considerable effect on combustion rate at initial steps of mixture ignition. High energy of activation at dissociation of source materials molecules results in either increase in ignition induction time or in complete absence of combustion. Increase of temperature of combustible gas mixture results in increase in thermal dissociation rate and growth of quantity of active species (in such a case chemical chains initiation is almost sure to occur). Thus, introduction of little quantity of atoms and radicals artificially, i.e. without initiation reaction, should result in increase in reaction rate and provide its proceeding at lower initial temperatures [5].

4. Formation of active species in gas during discharge. There are two forms of discharge in gas for initiation of ignition which should be considered. In case of the discharge resulting in formation of equilibrium plasma or near-equilibrium plasma (spark discharge, arc discharge) the main factor initiating combustion chain reaction development is local heating of gas and increase of thermal dissociation rate [9], [10]. In case of use of the barrier discharge as well as high-frequency and microwave discharges non-equilibrium plasmochemical processes can proceed. In non-equilibrium gas discharge plasma [11] ionization degree reaches $10^{-4}$-$10^{-1}$, electrons average energy (1-10 eV) considerably exceeds average translational energy of heavy particles, excited particles concentration considerably exceeds equilibrium concentrations. The issue on effective use of non-equilibrium plasma used in the claimed invention have remained open up till now.

At present the relative role of excitation of gas vibrational, electronic degrees of freedom as well as ionization and molecular dissociation by direct electron impact are being considered. In the case of realization of this considerable radical concentrations can form in non-equilibrium plasma. Basic processes of excitation of hydrogen and oxygen molecules have been analyzed in paper [23] and are reflected in the table [EEDF].

Elementary processes of excitation of H2 and O2 molecules by electron impact [23]

| Process | ΔE, eV |
|---|---|
| e + H2 → e + H2(v = 1) | 0.516 |
| e + H2 → e + H2(v = 2) | 1.000 |
| e + H2 → e + H2(v = 3) | 1.500 |
| e + H2 → e + H2(rot) | 0.044 |
| e + H2 → e + H2($d^3\Pi_u$) | 14.00 |
| e + H2 → e + H2($a^3\Sigma^+_g$) | 11.80 |
| e + H2 → e + H2($b^3\Sigma_g$) | 8.900 |
| e + H2 → e + H2($c^3\Sigma_u$ | 11.75 |
| e + H2 → e + H2($B^1\Sigma_u^+$) | 12.62 |
| e + H2 → e + H2($B^1\Sigma_u^+$) | 11.30 |
| e + H2 → e + H2($E^1\Sigma_g^+$) | 11.99 |
| e + H2 → e + H2($C^1\Pi_u$) | 12.40 |
| e + H2 → e + H2($e^3\Sigma_u^+$) | 12.83 |
| e + H2 → e + e + $H2^+$ | 15.40 |
| e + O2($j_1$) → e + O2($j_2$) | 0.005 |
| e + O2 → e + O2(v = 1) | 0.193 |
| e + O2 → e + O2(v = 2) | 0.382 |
| e + O2 → e + O2(v = 3) | 0.569 |
| e + O2 → e + O2(v = 4) | 0.752 |
| e + O2 → e + O2($a^1\Delta_g$) | 0.983 |
| e + O2 → e + O2($b^1\Sigma_g^+$) | 1.64 |
| e + O2 → e + O2($B^3\Sigma_u^-$) | 8.40 |
| e + O2 → e + O2($A^3\Sigma_u^+$) | 4.50 |
| e + O2 → e + O2($C^3\Delta_u$) | 6.87 |
| e + O2 → e + O2(9.9 eV) | 9.90 |
| e + O2 → e + O2(rydberg. number) | 13.5 |
| e + O2 → $O2^-$($X^2$□$_g$) → $O^-$($^2P^0$) + O($^3$P) | 4.25 |
| e + O2 → e + $O^+$ + $O^-$ | 15.0 |
| e + O2 → e + e + O($^3$P) + $O^+$($^4$S) | 18.0 |

On the one hand, even relatively small amount of atoms and radicals (about $10^{-5}$-$10^{-3}$ of the total number of particles) can shift equilibrium in the system and initiate a chain reaction. Moreover, in the case when such a concentration of active species is created uniformly through the volume combustion will certainly be non-detonating. On the other hand, formation of spatially uniform discharge in large volume at relatively high initial density of neutral particles is rather complicated from the technical standpoint. The claimed invention is aimed at solving this problem.

5. High-speed ionization wave (HSIW). High-voltage nanosecond pulse discharge developing in the form of a high-speed ionization wave is effective means of formation of spatially uniform highly excited non-equilibrium plasma. [12], [13].

6. Formation of active species in gas. A series of papers on application of high-speed ionization waves for plasma chemical investigations has become known today. Among them there are papers on study of nanosecond discharges impact on excitation of gas internal degrees of freedom [14] as well as on researches connected with study of kinetics of slow oxidation of hydrocarbons at room temperature under the effect of the high-speed ionization wave at pulse-repetition frequency of several tens of Hertz.

High-voltage nanosecond discharge as the method of ignition of combustible gas mixtures at high (about 1100-2200° K) initial translational temperatures has come under the scrutiny of science for the first time in papers [23], [24], [29], [31]. Ignition of methane-air mixtures and hydrogen-air mixtures diluted with argon or helium has been under consideration in these papers. On the basis of conducted calculations and experiments high effectiveness of the nanosecond high-voltage discharge allowing to substantially (up to 600° K in methane-air-argon mixture) reduce the ignition temperature threshold has been shown. It has been shown that at increase of gas density effectiveness of plasma chemical effect of discharge notably reduces. High-voltage nanosecond discharge spatial uniformity and its dependence on pressure of combustible mixture being ignited have been researched.

The aim of the invention is raising of effectiveness of initiation of ignition, of combustion intensification in internal combustion engines as well as raising of effectiveness of the process of combustible mixtures reforming using high-voltage periodic pulse discharge in gas.

The above aim has been set in connection with that due to high technologies development the acute problem of effective use of hydrocarbons as fuel has emerged in relation to specific cases, for example, at selection of modes for set combustible mixtures at use in internal combustion engines, jet rocket engines, jet aircraft engines, gas-turbine engines, pulse plasma-chemical lasers, plasma chemical reactors.

The aim of the invention is also provision of environmental safety of fuel combustion products with taking into account the fact that low-temperature combustion of hydrocarbon air mixtures results in carbon incomplete oxidation, clustering and formation, but on the other side, high-temperature combustion produces $NO_x$.

One of the rather actual problems at combustible mixtures ignition is the problem of their rapid ignition with set spatial distribution. Absence of detonation and hot spots in fuel-air mixtures combustion structure is critical in many applications. At the same time ignition velocity distribution throughout the space is essential for detonation engines. Different methods of initiation of ignition and sustaining gaseous-phase combustion are known today. The following methods can be distinguished among them: direct injection of direct current arc-discharge plasma [1]; laser-induced ignition [2], [3]; spark ignition [4].

Fuel oxidation reaction proceeds by a branched-chain mechanism [5] and formation of active sites is the slowest step in this process. The problem solved by the invention is to materially reduce ignition time and to initiate mixture combustion with set distribution throughout the volume—specifically, uniform distribution for air-jet engines and conventional engines, and gradient distribution for detonation engines, by acting on gas at initial steps of ignition.

The subjects of the claimed invention are also (1) creation of conditions for increase in mixture ignition velocity (reduction of induction time); (2) provision of gas ignition at lower initial temperature due to formation of active species in the volume of initial concentration.

The set problem is solved through the following: for initiation of ignition the combustible mixture in the combustion chamber is excited by means of pulsed periodic nanosecond high-voltage discharge, at that discharge amplitude U [kV] is limited by the following constraint:

$$3\cdot10^{-17}>U/(L\times n)>3\cdot10^{-18}$$

high-voltage pulse leading edge rise time $\tau_f$[ns] is limited by the constraint:

$$RC<\tau_f<3\cdot10^{-18}\times L^2\times n/U$$

and high-voltage pulse duration $\tau_{pul}$[ns] is limited by the constraint:

$$10^{17}/n<\tau_{pul}<3\cdot10^{20}\times(L\times R)/n$$

where U—high-voltage pulse amplitude, [kV];

L—discharge gap size, [cm], n—molecular concentration in the unit of discharge section volume, [$cm^{-3}$], R—power line resistance [Ohm], C—discharge gap capacitance [F].

Discharge section volume is the volume in which combustion is initiated by high-voltage nanosecond discharge.

In order to provide stable regime of chemical reactions in combustible mixture in continuous mode high-voltage periodic pulse discharge in gas should have pulse interval $f_{pul}$ [$sec^{-1}$] limited by the constraint:

$$10^{26}U/(n\times L^2)>f_{pul}>V/L$$

where U—high-voltage pulse amplitude, [kV];

n—molecular concentration in the unit of discharge section volume, [$cm^{-3}$],

V—gas flow speed in the discharge section, [cm/sec].

The technical result of the invention consists in reduction of combustible mixtures ignition temperature, increase of intensity of chemical reactions in combustion and reforming processes, and, as a consequence, raising of effectiveness of engines, power burners and reformers and material reduction of release of harmful substances, specifically nitrogen oxides, into the atmosphere.

The proposed electrodynamic characteristics of the discharge in combustible mixture allow to materially reduce ignition temperature threshold of the combustible mixture for the following reasons:

1) High-voltage pulse amplitude limited by the constraint $U[kV]>3\cdot10^{-18}\times L\times n$ sets the value of the reduced electric field E/n in the discharge gap after its overlapping by the breakdown wave at the level of higher than 300 Td which provides maximization of the discharge energy deposition in electronic degrees of freedom and gas dissociation.

2) High-voltage pulse amplitude limited by the constraint $U[kV]<3\cdot10^{-17}\times L\times n$ sets the value of the reduced electric field E/n in the discharge gap after its overlapping by the breakdown wave at the level of lower than 3000 Td which prevents plasma electrons transfer into the whistler mode at the basic stage of discharge and minimizes electron energy increase loss, electron beam formation and X-ray emission.

3) High-voltage pulse leading edge rise time limited by the constraint $\tau_f[ns]<3\cdot10^{-18}\times L^2\times n/U$ allows to increase voltage on the high-voltage electrode and to obtain the field intensity sufficient for electrons transfer into the whistler mode at ionization wave front within the time less than the time of overlapping of the gap which conditions attainment of uniformity of filling the discharge gap with plasma.

4) High-voltage pulse leading edge rise time limited by the constraint $\tau_f[ns]>RC$ allows to interface the high-voltage impulse generator with the discharge cell which conditions effectiveness of pulse energy transfer to plasma.

5) At high-voltage pulse duration limited by the constraint $\tau_{pul}[ns]<3\cdot10^{20}\times(L\times R)/n$ total energy put into gas-discharge plasma is limited, discharge instability development, its pinching and the channel overheating are prevented due to which strong non-equilibrium character of pulse discharge plasma is attained.

6) High-voltage pulse duration limited by the constraint $10^{17}/n<\tau_{pul}[ns]$ accounts for end time of electron multiplication in the discharge gap within the limits of fields limited by the constraints 1) and 2). Execution of this condition is required for gas ionization development in the gap after its overlapping by the breakdown wave which causes reduction of the discharge gap resistance, its better interface with the generator and effective electric energy deposition into plasma.

7) In order to provide stable proceeding of chemical reactions in continuous mode pulse interval is limited by the constraint $10^{26}\ U/(n\times L^2)>f_{pul}>V/L$, where U—high-voltage pulse amplitude, [kV];

n—molecular concentration in the unit of discharge section volume, [$cm^{-3}$],

V—combustible mixture flow speed in the discharge section, [cm/sec].

The above values of the pulse interval ($f_{pul}$) provide uniformity of gas excitation (absence of gas "breakthrough") in continuous mode ($f_{pul}>V/L$) and high effectiveness of strong non-equilibrium regime of excitation by nanosecond discharge with high duty ratio ($10^{26}\ U/(n\times L^2)>f_{pul}$) when the time between pulses exceeds the pulse duration and provides the time sufficient for plasma recombination, recovery of electric strength of the gap and guarantees operation in the selected range of reduced electric fields (constraint 1).

In the course of experimental study of the claimed method effect of non-equilibrium discharges on characteristics of chemical processes of combustion and reforming (propagation rate, temperature, quantity of $NO_x$ impurities in combustion products, etc.) has been established. As for burners effect of gas excitation by nanosecond pulse discharge on flame blow-off velocity has been understood. In the course of experiments increase in flame blow-off velocity by more than two times at the discharge energy deposition of less than 1% of the burner capacity was obtained. On the basis of data obtained using emission spectroscopy methods it has been established that increase of flame propagation velocity is connected with formation of atomic oxygen in the discharge as a result of quenching of the electron-excited molecules of nitrogen on oxygen as well as with oxygen dissociation by electron impact. The constructed numerical model has described qualitatively influence of the discharge on flame propagation velocity. Influence of nanosecond pulse repetition frequency on flame blow-off velocity and size has been understood. It has been established that velocity increase effect becomes stronger as the frequency increases. Such a behavior is connected with additional generation of active species in the discharge. Discharge power in this instance was not more than 1% of the burner capacity.

BRIEF DESCRIPTION OF THE DRAWINGS

The drawings illustrating the essence of the invention show the following.

IMPLEMENTATION OF THE INVENTION

Possibility of implementation of the claimed method has been experimentally proved and modes of its application have been substantiated by investigation of fuel-air mixtures ignition at different regimes and by comparison of effectiveness of different methods of initiation of ignition and intensification of the combustible mixture combustion.

The shock tube applied in the experimental assembly is widely used for controlled generation of high temperatures at study of physical-chemical processes in gas. At development of the claimed method the shock tube was used for gas heating. Nanosecond discharge occurred behind the reflected shock-wave front.

Figure 1:
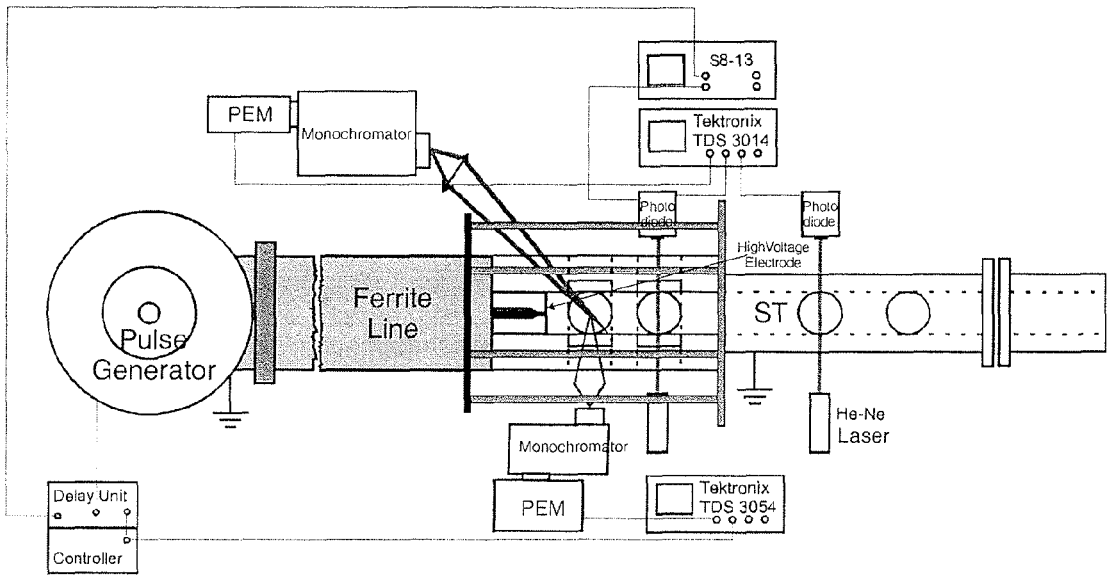
FIG. 1 is general schematic view of the experimental assembly.

The shock tube low-pressure chamber used in the experiments had a rectangular internal cross-section of 25×25 mm and consisted of steel and dielectric parts connected with each other (FIG. 1). The dielectric section formed the terminal part of the low-pressure chamber. The shock tube end located in the dielectric section formed a high-voltage electrode from which the discharge developed.

In experiments on mixtures ignition using high-speed ionization wave the nanosecond discharge was created directly in the heated gas behind the reflected shock-wave. Pulse technique used for high power generation in the plasma experiment is based on application of electromagnetic energy storage devices and realized according to the following sequence: primary energy storage unit→switching device→pulse shaper→switching device→transmission line→load.

Figure 2:
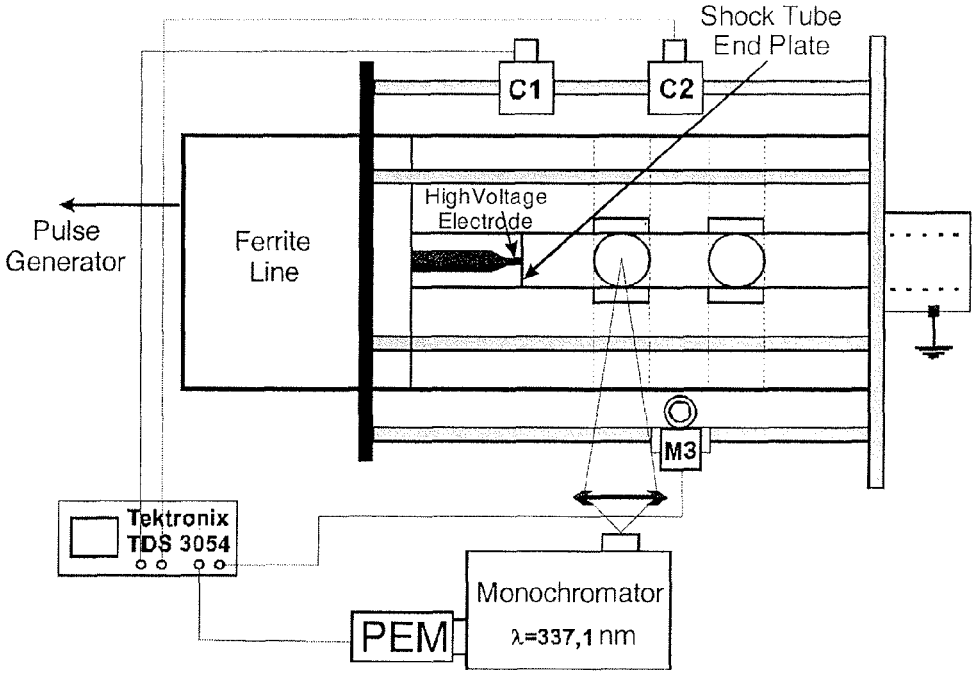
FIG. 2 shows the shock tube discharge chamber. Diagnostics of HSIW electrodynamic characteristics.

ГИН-9 ten-stage generator was used for creation of discharge. The frame of this high-voltage impulse generator was filled with nitrogen compressed to 3.6 atm which made it possible to obtain voltage pulses of up to 250 kV. The discharge chamber design is shown in FIG. 2 in detail. High-voltage brass electrode was arranged in the end part of the chamber in such a way so that its effective surface (contacting with the mixture) was positioned flush with the low-pressure chamber edge as shown in FIG. 2. The discharge developed from the high-voltage electrode and to the steel grounded part of the low-pressure chamber.

Radiation CH (λ=431 mm, $A^2\Delta \rightarrow X^2\Pi$) or OH (λ=306 mm, $A^2\Sigma \rightarrow X^2\Pi$) of radicals was detected in each experiment.

Figure 3:
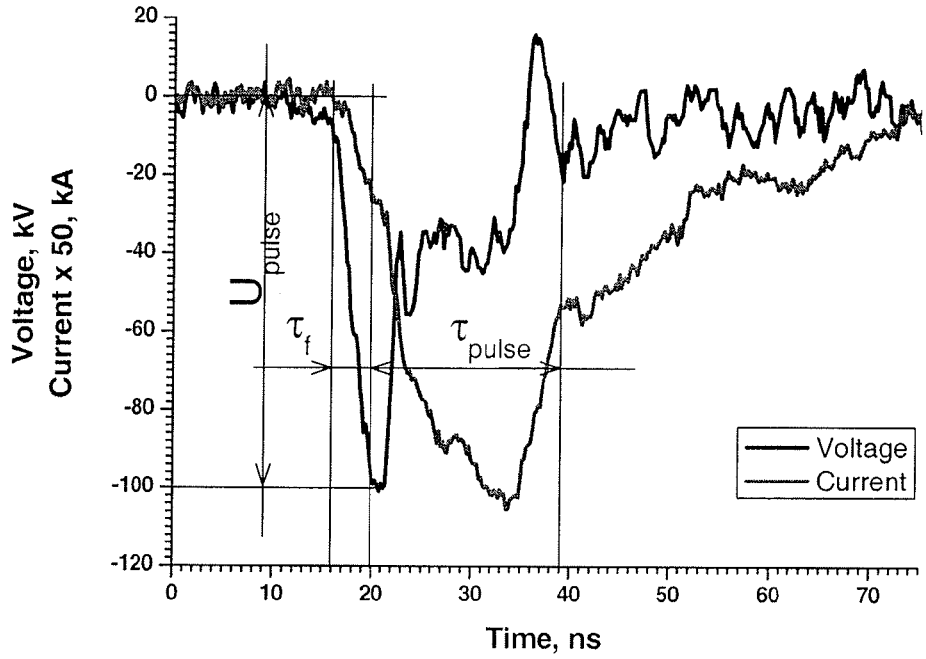
FIG. 3 shows oscillograms in the microsecond range from two Schlieren detectors and the electron-multiplier phototube.

Ignition time was determined based on radiation of CH or OH radicals at the corresponding wave lengths. Characteristic oscillograms obtained from the experiments are given in FIG. 3. The uncertainty in the measurement of ignition delay time was estimated as no more than 10 μsec.

In order to check coincidence of ignition induction times obtained with detection of radiation of CH and OH radicals an experiment on determination of times of induction in stoichiometric butane-oxygen mixture diluted with argon by 20% (Dilution of mixtures with argon is a typical method used for imposition of isothermal conditions on reactions) has been conducted. As is clear from FIG. 4 ignition delay times-post-reflected shock wave temperature curves coincide for measurements conducted at detection of radiation of radicals OH and CH, correspondingly (λ=306 mm) and (λ=431 mm).

Measurements of the high-speed ionization wave (HSIW) parameters included measurement of current and drop of voltage in the discharge gap against the time for determination of the discharge energy deposition into gas behind the reflected shock wave and field intensity of HSIW with nanosecond resolution. Nanosecond measurements also included detection of radiation of CH radical at HSIW propagation throughout the discharge gap.

Potential drop in the discharge chamber was determined based on two oscillograms obtained from capacitance sensors. During measurements capacitance sensors were placed between the grounded shield and the discharge section (C1 and C2 in FIG. 4). Transfer capacitance made 460 pF. Tektronix TDS-3054 oscilloscope (400 MHz bandwidth) with input impedance of 50 Ohm was used for signal recording. Current in the discharge device was measured by means of the magnetic current sensor. Potential drop $\Delta U(t)=U_2(t)-U_1(t)$ in the area including the observation cross-section was determined based on difference in signals from capacitance sensors. Electric field intensity was defined as $E\sim\Delta U/L$, where $L^{\sim}$ is distance between the sensors. Electron density was determined from measurements of the current on the hypothesis that the current flows uniformly across the cross-section of the discharge device: $J(t)=n_c(t)V_{dr}E(t)\ S$, where $J^{\sim}$ is the measured current value, $n_c^{\sim}$—sought electron density, $V_{dr}^{\sim}$—electron drift velocity in the current reduced electric field E/n(t), $S^{\sim}$—cross-section area of the discharge device.

Power deposited into the discharge was continuously calculated with taking into account measurements of the current synchronized with the voltage potential measurement:

$$P(t)=\Delta U(t)I(t)$$

Specific energy deposition into gas was determined by way of integration of the above expression on the assumption of the discharge spatial uniformity in the volume V=LS, where L~ is distance between the capacitance sensors, S~—cross-section area of the discharge device.

Radiation of CH radical (transfer λ=431 nm, $A^2\Delta \rightarrow X^2\Pi$) was controlled with nanosecond time resolution simultaneously with control of current and voltage. Radiation coming from the diagnostic window of the discharge chamber effective cross-section was monochromated by means of MYM monochromator and recorded by 14 ЭUIY-ΦT high-current photomultiplier (see FIG. 2).

TABLE 2

Studied combustible mixtures.

| Alkane | $CH_4$ | $C_2H_6$ | $C_3H_8$ | $C_4H_{10}$ | $CH_4$ | $C_2H_6$ | $C_3H_8$ | $C_4H_{10}$ | $C_5H_{12}$ |
|---|---|---|---|---|---|---|---|---|---|
| | 6.7% | 4.4% | 3.3% | 2.7% | 3.3% | 2.2% | 1.7% | 1.3% | 1.1% |
| O2 | 13.3% | 15.6% | 16.7% | 17.3% | 6.7% | 7.8% | 8.3% | 8.7% | 8.9% |
| Ar | 80% | 80% | 80% | 80% | 90% | 90% | 90% | 90% | 90% |

Figure 4:
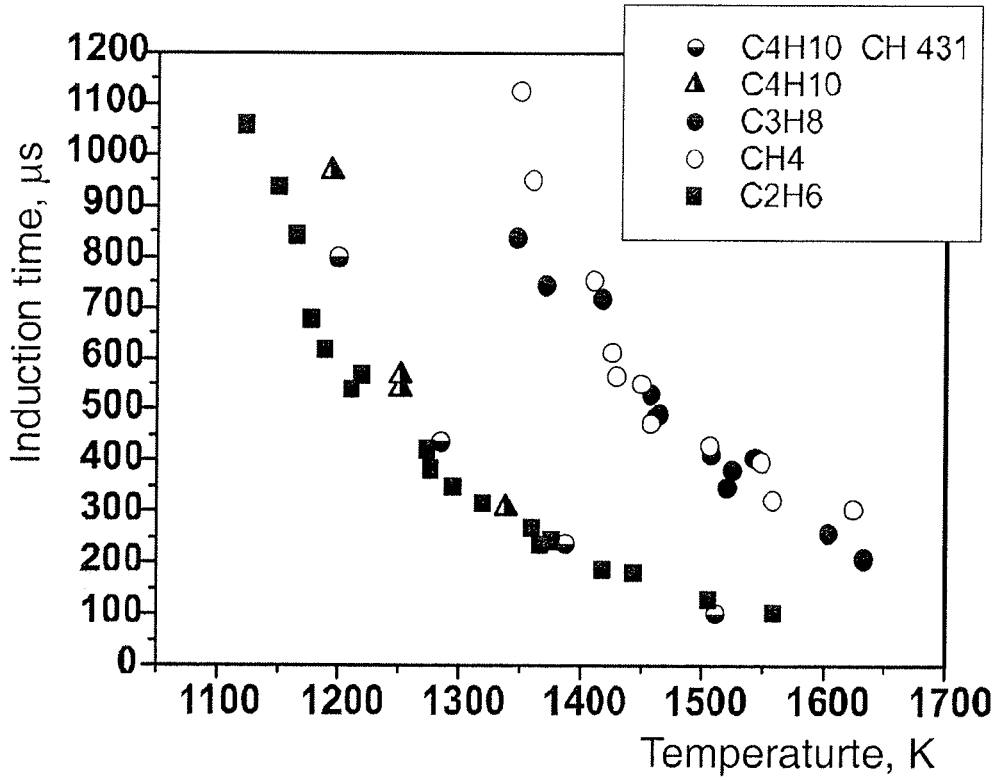
FIG. 4 shows curves of autoignition of 20% hydrocarbon mixtures.
Figure 5:
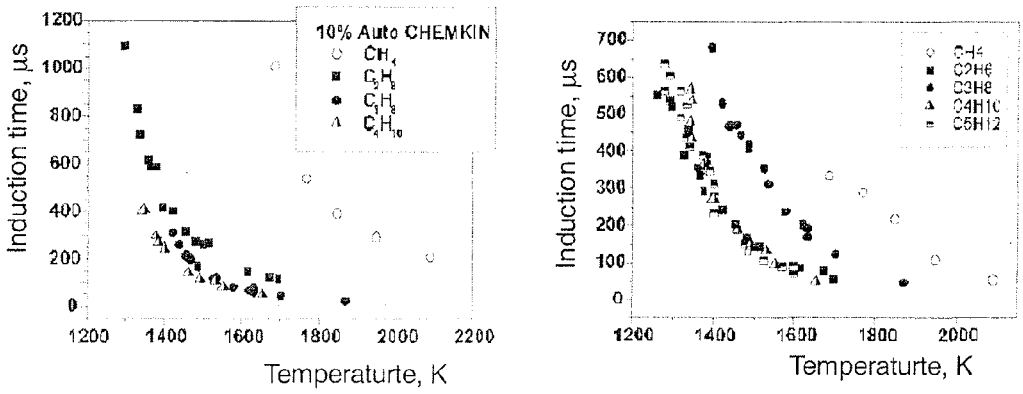
FIG. 5 shows curves of autoignition of 2%, 10% and 20% stoichiometric propane-oxygen mixtures diluted with argon.

In the course of investigations experiments on ignition of stoichiometric methane-oxygen, ethane-oxygen, propane-oxygen and butane-oxygen mixtures diluted with argon by 80% (see table 2), hydrogen-air mixtures and methane-air mixtures were conducted. Basic results of these experiments are shown in the induction time-reaction gas post-reflected shock wave temperature in the form of autoignition curves given for comparison with the invention (FIG. 4, 5).

Basic set of working data reflecting kinetics of the autoignition process was obtained using stoichiometric methane-oxygen, ethane-oxygen, propane-oxygen and butane-oxygen mixtures (see table 2) diluted with argon by 90%.

Figure 6:
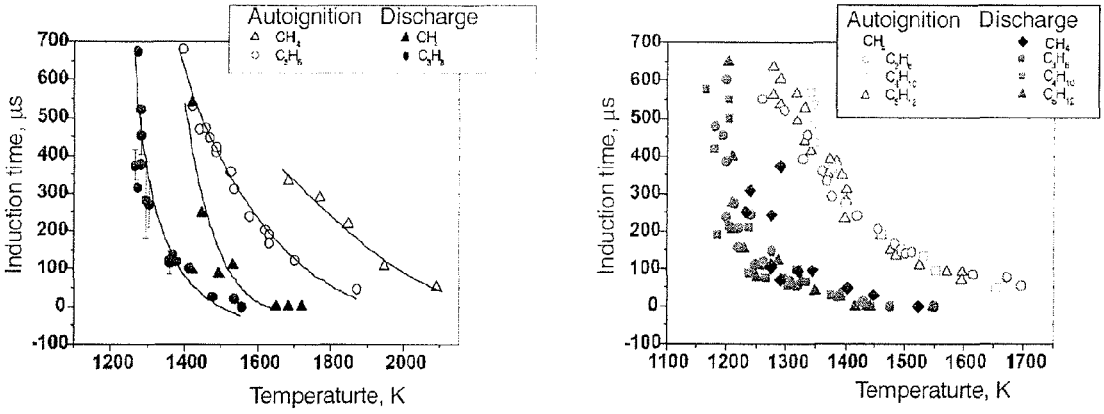
FIG. 6 shows curves of autoignition and curves of discharge-induced ignition of 10% stoichiometric C1-C5-oxygen mixtures diluted with argon.

Experiments on initiation of ignition by nanosecond discharge were made on stoichiometric mixtures diluted with argon by 10% (see FIG. 6, 7).

10% mixtures $CH_4$: $O_2$: Ar=1:2:27

$C_2H_6$: $O_2$: Ar=2:7:81

$C_3H_8$: $O_2$: Ar=1:5:54

$C_4H_{10}$: $O_2$: Ar=2:13:135

$C_5H_{12}$: $O_2$: Ar=1:8:81 diluted by 20%:

$CH_4$: $O_2$: Ar=1:2:13

$C_2H_6$: $O_2$: Ar=2:7:36

$C_3H_8$: $O_2$: Ar=1:5:24

$C_4H_{10}$: $O_2$: Ar=2:13:60

Ignition threshold shifts within the range of 200 to 500° K were observed for each mixture. Larger ignition temperatures shifts was observed for less diluted 20% mixtures as compared to highly diluted mixtures. It should be noted that results of the experiments on ignition of 10% $CH_4$: $O_2$: Ar=1:2:27 mixture by means of HSIW are close to results of the same experiments on 20% $CH_4$: $O_2$: Ar=1:2:13 mixture but as compared to the 20% mixture the 10% mixture could not ignite automatically while ignition of the same was executed using the claimed method.

Figure 7:
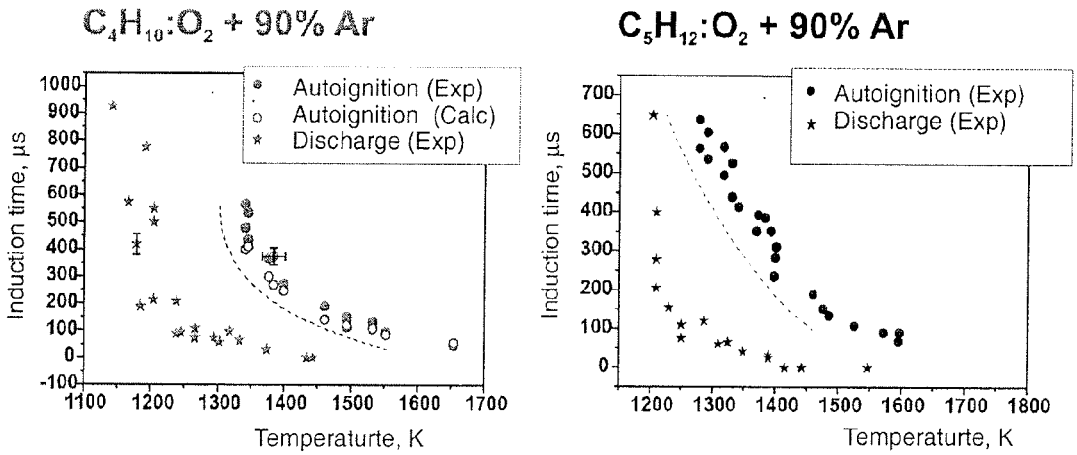
FIG. 7 shows curves of discharge-induced ignition and curves of autoignition of 10% stoichiometric C4-C5-oxygen mixtures diluted with argon. The dotted lines indicate ignition temperature hypothetical shifts calculated based on data of each experiment at equilibrium discharge energy deposition into gas.

In all experiments on initiation of combustion by high-voltage pulse discharge measurements of the current and voltage in the discharge gap were made and density of energy deposited into the mixture by high-voltage discharge was calculated. In order to compare effectiveness of ignition by non-equilibrium energy deposition (HSIW) with equilibrium heating the discharge energy deposition density was recalculated into mixture thermal heating energy. The calculated equilibrium shifts of ignition are indicated in FIG. 7 by dotted lines. It is apparent that non-equilibrium method of energy deposition allows to reduce ignition temperature threshold by the value exceeding by 2̃-4 times the shift obtained at equilibrium heating with depositing the same amount of energy.

Figure 8:
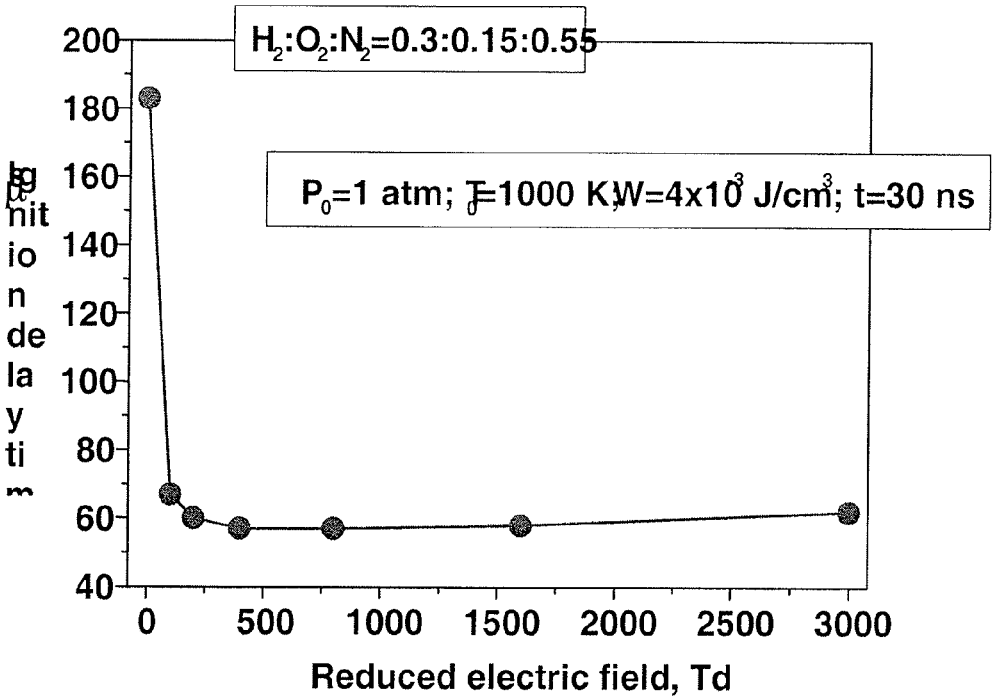
FIG. 8 shows reduction of time of energy release in the system at fixed energy deposition into discharge depending on the value of the applied electric field (E/n[Td]~U/(L*n)).

High-voltage pulse amplitude limited by the constraint $U[kV]>3\sim10^{18}\times L\times n$ sets the value of the reduced electric field E/n in the discharge gap after its overlapping by the breakdown wave at the level of higher than 300 Td which provides maximization of the discharge energy deposition in electronic degrees of freedom and gas dissociation. FIG. 8 shows dependence of calculated time of energy release in the hydrogen-air mixture on the value of the applied electric field at fixed energy deposition into discharge. It is apparent that maximum effect is achieved over the range of reduced fields of 300 to 3000 Td.

Figure 9:
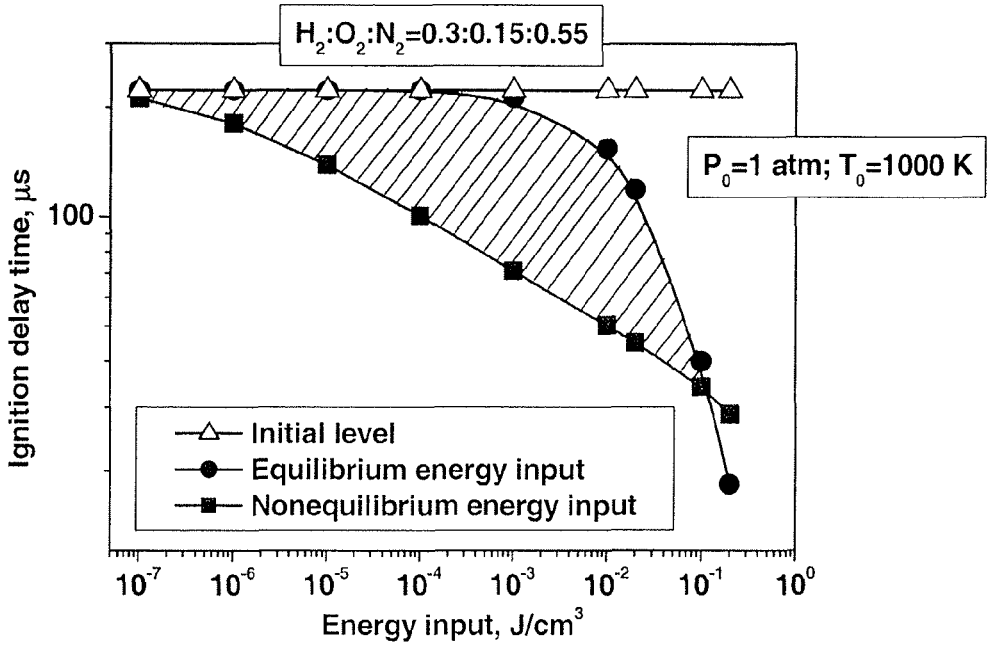
FIG. 9 shows reduction of time of energy release in the system at fixed value of the applied electric field of 500 Td depending on the discharge energy deposition.

At high-voltage pulse duration limited by the constraint $\tau_{pul}[ns]<3\cdot10^{20}\times(L\times R)/n$ total energy put into gas-discharge plasma is limited, discharge instability development, its pinching and the channel overheating are prevented due to which strong non-equilibrium character of pulse discharge plasma is attained and the discharge effectiveness in comparison with gas thermal heating increases (FIG. 9). FIG. 9 shows reduction of time of energy release in the system at fixed value of the applied electric field of 500 Td depending on the discharge energy deposition. It is apparent that at increase of the total energy of the discharge (the value proportional to high-voltage pulse duration at fixed voltage amplitude) effectiveness of non-equilibrium excitation reduces. Effectiveness of different excitation methods is compared at energy deposition values of about 1 J/cm$^3$ in normal conditions, which limits pulse duration by the value $$\tau_{pul}[ns]<3\cdot10^{20}\times(L\times R)/n,$$

where L—discharge gap size, [cm],

R—power line resistance, [Ohm], n—molecular concentration in the unit of discharge section volume, [cm$^{-3}$].

As it follows from the foregoing (see FIG. 7), for all hydrocarbon-oxygen mixtures acceleration of ignition under the action of the single-pulse high-voltage nanosecond discharge was observed as contrasted to absence of such accelerated autoignition in the same conditions behind reflected shock wave. Induction time and ignition temperature threshold reduced within the aforementioned temperature and pressure ranges.

Assessments of high-voltage discharge energy deposition have shown that effectiveness of non-equilibrium generation of radicals at ignition is two̜-four times higher than that of equilibrium heating. The effect of ignition acceleration by high-voltage nanosecond discharge increases as the relative concentration of diluent in combustible mixture is reduced.

Figure 10:
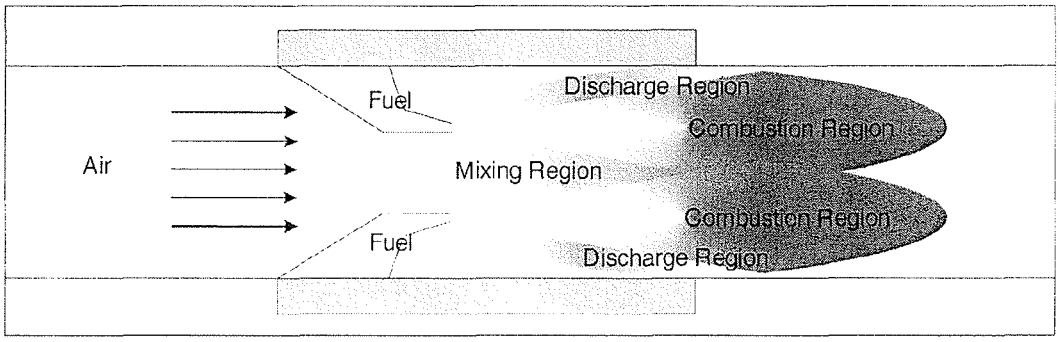
FIG. 10 illustrates one embodiment of use of pulse discharges for initiation of ignition and intensification of the combustible mixture combustion in jet engines and burners with non-mixed flow.

Exemplary embodiments of use of pulse nanosecond discharges for initiation of ignition, combustion intensification and reforming of combustible mixtures The claimed method can find practical use, for example, in jet engines and burners with non-mixed flow for initiation of ignition and intensification of combustible mixture combustion (FIG. 10).

In the case of such use oxidant (air) flow enters the combustion chamber after being compressed by the compressor (gas turbine engines), the pressure wave system (ram jets), without pre-compression (burners). In the combustion chamber air flow is mixed with fuel and in some mixing zones areas such fuel/oxidant mixing conditions are attained (as a rule, but without limitation, stoichiometric fuel/oxidant ratio lies within the range of 0.25-4) at which ignition becomes possible. Discharge is applied to the mixing area causing intensification of inflammation and agitation due to local inflammation and enhancement of gas turbulence.

Figure 11:
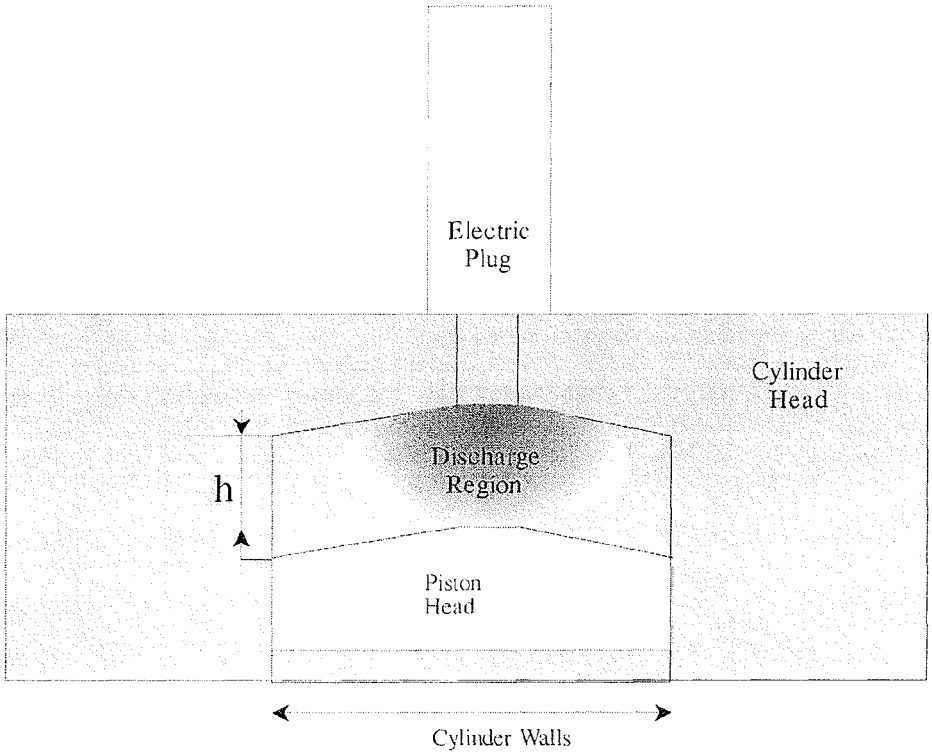
FIG. 11 illustrates one embodiment of use of pulse discharges for initiation of ignition and intensification of the combustible mixture combustion in the car internal combustion engine.

Exemplary embodiment of use of the invention in car internal combustion engines is illustrated in FIG. 11. Discharge is created in the gap between cylinder head and piston initiating ignition throughout the entire volume at low concentration of fuel in mixture which results in reduction of burning time, decrease in fuel consumption and reduction of pollutant emissions.

Figure 12:
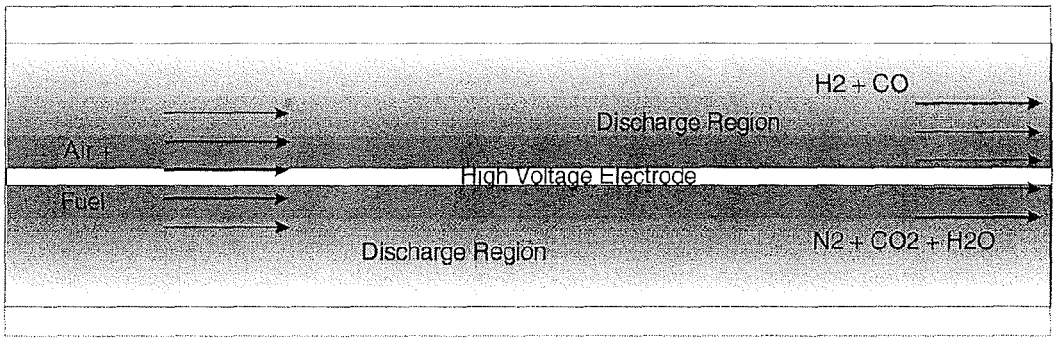
FIG. 12 illustrates one embodiment of use of pulse discharges for initiation of combustible mixtures combustion-reforming in the plasma reformer.

Exemplary embodiment of use of pulse discharges for initiation of combustible mixture combustion-reforming in plasma reformer is illustrated in FIG. 12. Discharge is created in the coaxial gap between internal high-voltage electrode and outer reformer wall initiating plasma catalysis throughout the entire volume at high concentration of fuel in mixture which results in low-temperature reforming of hydrocarbon fuel into hydrogen, reduction of energy consumption per unit of hydrogen evolved and decrease in amount of hydrocarbons at the reformer outlet.

Figure 13:
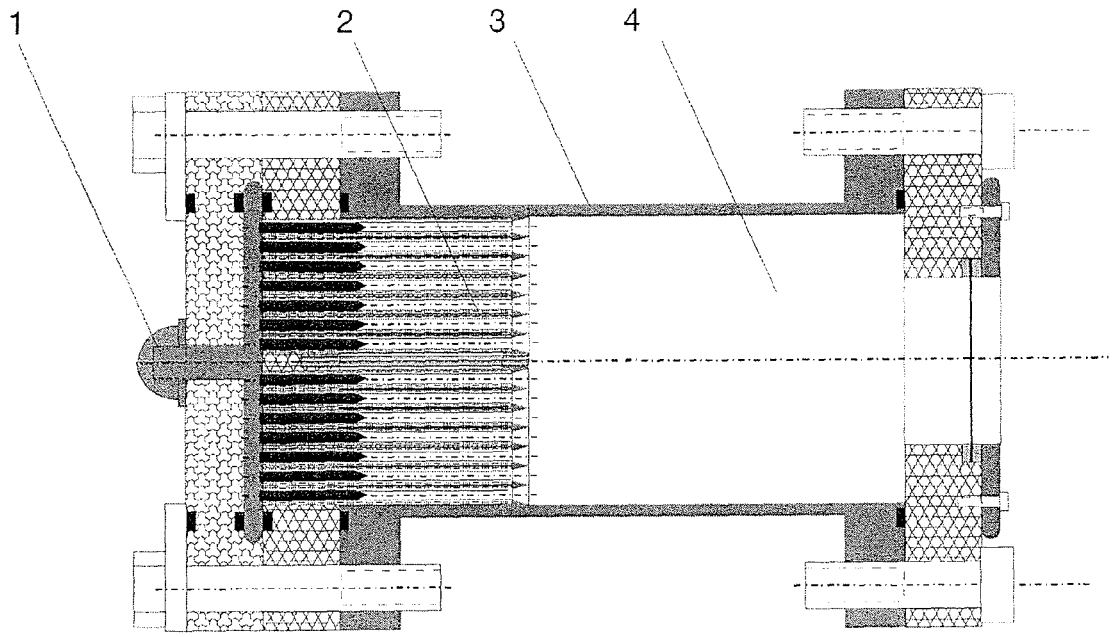
FIG. 13 illustrates one embodiment of use of pulse discharges for initiation of a detonation wave in detonation combustion chamber, namely a schematic view of the detonation combustion chamber: 1—high-voltage input; 2—set of discharge tubes 3—chamber casing; 4—detonation wave forming region.
Figure 14:
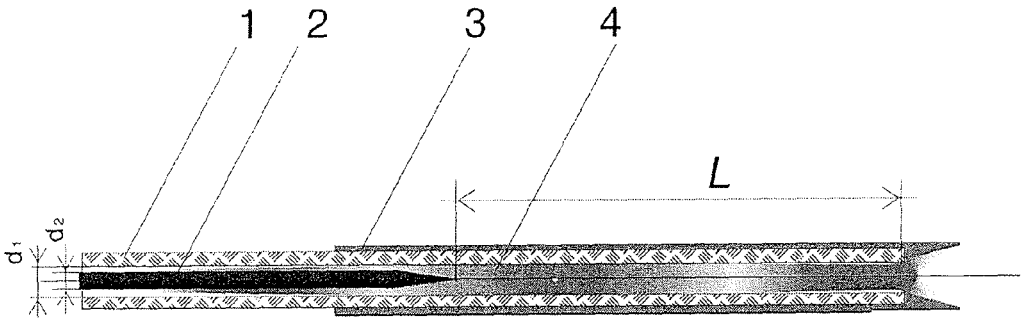
FIG. 14 illustrates a schematic view of the discharge tube: 1—dielectric layer; 2—high-voltage electrode; 3—low voltage electrode; 4—the region of gas discharge and combustion formation.

Exemplary embodiment of use of the claimed method for initiation of detonation in detonation engines and combustion chambers is illustrated in FIGS. 13 and 14. FIG. 13 shows general view of the large cross-section detonation combustion chamber in which separate discharge sections are mounted (FIG. 14). Discharge is created in the space with barrier (insulator partially covering the low-voltage electrode, FIG. 14). Such geometry allows to maintain a high value of electric field in the discharge region and to use relatively low voltages for achieving uniformity of plasma formation $$3^{-17} > U/([d_1 - d_2]/2 \times n) > 3 \cdot 10^{-18}$$

and relatively low values of rate of voltage increase across the gap $$\tau_f < 3 \cdot 10^{-18} \times L^2 \times n/U$$

even at high initial gas pressures typical for detonation combustion chambers. The unique feature of this embodiment of discharge is that the value of the reduced field in the discharge gap is governed by the smallest distance between electrodes $[d_1\text{-}d_2]/2$, and the time of filling the gap and reaching short-circuiting conditions by discharge is governed by the distance between the high-voltage electrode and that part of the low-voltage electrode which is not covered by dielectric layer (FIG. 14).

LIST OF REFERENCES

1. T. Tachibana//Proc. 26th (Int.) Sympos. on Combust. Napoli, 1996. WIP Abstracts. P. 385.

2. M. Lavid, D. Zhou, Y.-C. Li//Proc. 26th (Int.) Sympos. on Combust. Napoli, 1996. WIP Abstracts. P. 410.

3. H. Furutani, F. Liu, J. Hama, S. Takahashi//Proc. 26th (Int.) Sympos. on Combustion. Napoli, 1996. WIP Abstracts. P. 394.

4. G. Pilch, A. Britan, Bon-Dor Gabi, E. Sher//Proc. 27th (Int.) Symp. on Combust. Boulder, 1998. WIP-Abstracts. P. 95.

5. N. N. Semenov, Nobel Lecture, Dec. 11, 1956.

6. I. A. Semiokhin, B. V. Strakhov, A. I. Osipov. Kinetics of Chemical Reactions. M., MSU Publishing House, 1995.

7. A. P. Purmal. Simple Kinetics of Complex Reactions. M.: MPTI Publishing House, 1998.

8. E. T. Denisov. Kinetics of Homogeneous Chemical Reactions. M.: Higher School Publishing House, 1988.

9. E. C. Samano, W. E. Carr, M. Seidl, and Brian S. Lee. An arc discharge hydrogen atom source,//Review of Scientific Instruments 64 (10) (1993) 27462752.

10. D. A. Eichenberger and W. L. Roberts, Combust. Flame 118 (1999) 469.

11. L. S. Polak, A. A. Ovsyannikov, D. I. Solovetskiy, F. B. Vurzel. Theoretial and Applied Plasma Chemistry. M.: Nauka Publishing House, 1975.

12. L. M. Vasiliak, S. V. Kostuchenko, N. N. Kudriavtsev, I. V. Filugin. High-Speed Ionization Waves at Electric Breakdown.//Uspekhi Fizicheskikh Nauk Publishing House, Vol. 164 (No. 3), 1994, p. 161285.

13. Zatsepin, Starikovskaya, Starikovskiy. Development of a Spatially Uniform High-Speed Ionization Wave in a Large Discharge Volume.//Plasma Physics Reports, 1998, Vol. 24, No. 7, p. 1-7.

14. S. M. Starikovskaya. Pulse Discharge at High Overvoltages: Peculiarities of Development and Excitation of Gas Internal Degrees of Freedom. Doctoral Thesis, 2000, p. 1221.

15. A. A. Radtsig, B. M. Smirnov. Handbook on Atomic and Molecular Physics. M.: Atomizdat Publishing House, 1980.

16. A. P. Zuev, A. Yu. Starikovskiy. Absorption Cross-Sections of the Molecules O2, NO, N2O, CO2, H2O, NO2 in the UV Region of Spectra.//Journal of Applied Spectroscopy, 1990, March (3), Vol. 52, p. 455-466.

17. Ya. B. Zeldovich, Yu. P. Raizer. Physics of Shock Waves and High-Temperature Hydrodynamic Phenomena. Second Enlarged Edition. M.: Nauka Publishing House, 1966.

18. Statistical Physics, part I, Landau L. D., Lifshits E. M., Moscow 1976.

19. Thermodynamic Properties of Individual Substances, edited by Glushko V. P., Nauka Publishing House, Moscow 1978.

20. J. Craggs, R. Meek. High Voltage Laboratory Technique. Butterworth Scientific Publishers, London, 1954.

21. S. A. Bozhenkov. Study of high-speed ionization wave influence on ignition of hydrogen-air and methane-air mixtures. B.Sc. thesis, 2002.

22. S. A. Bozhenkov, S. M. Starikovskaia and A. Yu. Starikovskii. Nanosecond gas discharge ignition of H2 and CH4 containing mixtures.//Combustion and Flame 133 (2003) 133146.

23. G. P. Smith, D. M. Golden, M. Frenklach et al., http://www.me.berkeley.edu/gri_mech/

24. C. D., Carter, S., Williams, L. C., Lee, S., Sidhu, J., Graham. AIAA Paper 2003-0703. 41st Aerospace meeting and Exibit. 6-9 January, Reno, Nev., USA.

25. E. I., Mintoussov, S. V., Pancheshnyi, A. Yu., Starikovskii. AIAA paper 2004-1013. 42nd Aerospace meeting and Exibit. 5-8 Jan. 2004, Reno, Nev., USA 26. J. W., Parish, B. N., Ganguly. AIAA paper. 42nd Aerospace meeting and Exibit. 5-8 Jan. 2004, Reno, Nev., USA.

27. E. N. Kukaev. Investigation of Ignition of Combustible Mixtures by a Nanosecond Gas Discharge and Flash Photolysis. M.Sc. thesis, 2004.

28. H. Okabe. Photochemistry of Small Molecules. M.: Mir Publishing House, 1981.

29. S. M., Starikovskaia, E. N., Kukaev, A. Yu., Kuksin, M. M., Nudnova, A. Yu., Starikovskii. Analysis of the spatial uniformity of the combustion of a gaseous mixture initiated by a nanosecond discharge.//Combustion and Flame. 193 (2004) 177187

30. N., Lamoureux, C.-E., Paillard, V., Vaslier. Low hidrocarbon mixtures ignition delay times investigation behind reflected shock waves.//Shock waves, (2002) 11: 309322

31. E. V. Stupochenko, S. A. Losev, A. I. Osipov. Relaxation Processes in Shock Waves. M.: Nauka Publishing House, 1965.

The invention claimed is:

1. The method of initiation of ignition, of intensification of combustion or reforming of combustible fuel-air or fuel-oxygen mixture comprising providing a combustible mixture in a combustion chamber and exciting the combustible mixture by means of pulsed periodic nanosecond high-voltage discharge, wherein the discharge is characterized by the following:

discharge amplitude U [kV] is limited by the constraint:

$$3\cdot10^{-17}>U/(L\times n)>3\cdot10^{-18},$$

high-voltage pulse leading edge rise time $\tau_f$ [ns] is limited by the constraint:

$$RC<\tau_f<3\cdot10^{-18}\times L^2\times n/U,$$

and high-voltage pulse duration $\tau_{pul}$ [ns] is limited by the constraint:

$$10^{17}/n<\tau_{pul}<3\cdot10^{20}\times(L\times R)/n$$

where U—high-voltage pulse amplitude, [kV];

L—typical size of the discharge gap, [cm], n—molecular concentration in the unit of discharge section volume, [$cm^{-3}$], R—power line resistance [Ohm], C—discharge gap capacitance [F].

2. Method as claimed in claim 1, wherein the high-voltage periodic pulse discharge is at a pulse interval $f_{pul}$ [$sec^{-1}$] limited by the constraint:

$$10^{26}U/(n\times L^2)>f_{pul}>V/L$$

where V—gas (combustible mixture) flow speed in the discharge section, [cm/sec].

* * * * *